US005888155A

United States Patent [19]

Lee

[11] Patent Number: 5,888,155

[45] Date of Patent: Mar. 30, 1999

[54] AUTOMATIC TENNIS BALL SUPPLY DEVICE

[76] Inventor: Suk Gyu Lee, 8-2, Komo-ri, Sohol-eub, Pochon-kun, Kyoungki-do 487-820, Rep. of Korea

[21] Appl. No.: 4,574

[22] Filed: Jan. 8, 1998

[30] Foreign Application Priority Data

Dec. 12, 1997 [KR] Rep. of Korea ..... 97-68100

[51] Int. Cl.[6] ..... A63B 69/40

[52] U.S. Cl. ..... 473/459; 124/16

[58] Field of Search ..... 473/422, 459; 124/16

[56] References Cited

U.S. PATENT DOCUMENTS

| | | | |
|---|---|---|---|
| 3,610,223 | 10/1971 | Green | 124/16 |
| 3,779,227 | 12/1973 | Scott | 124/16 |
| 4,168,695 | 9/1979 | Haller et al. | 124/16 |
| 5,494,022 | 2/1996 | Sung | 124/16 X |
| 5,562,282 | 10/1996 | Stevenson | 124/16 X |

*Primary Examiner*—Raleigh W. Chiu

*Attorney, Agent, or Firm*—Steinberg & Raskin, P.C.

[57] ABSTRACT

An automatic tennis ball supply device, includes: a spring for transmitting the power via its elasticity; a first shaft which is joined to part "b" which is the first part of a steel band of the spring; a handle for winding the spring; a first gear which rotates in the same direction as the first shaft; a second gear which rotates to the left when the wound spring runs down; a latch for disengaging the first and second gears from each other when the spring is wound, and for engaging the first and second gears with each other when the wound spring runs down; a third gear which rotates to the right, when the second gear rotates to the left; a second shaft which rotates in the same direction as the rotating third gear; a rotative speed control unit for controlling a rotative speed of the second shaft; a ball pick up unit for picking up and conveying one of the plural tennis balls in a container; a ball guide unit for guiding the tennis ball to outside. The automatic tennis ball supply device of the present invention, is given the power generated by the spring which is wound and then runs down, and thus picks up the plural tennis balls in the container one by one, before supplying the ball to the user, for user's tennis posture practice. Therefore, it is convenient to automatically supply the balls, instead of other people's throwing the balls to the user directly.

3 Claims, 7 Drawing Sheets

AUTOMATIC TENNIS BALL SUPPLY DEVICE

BACKGROUND OF THE INVENTION

1. Field of the Invention

The present invention relates to an automatic tennis ball supply device. More particularly, it relates to an automatic tennis ball supply device, which picks up a plurality of tennis balls in a container one by one, by means of the power generated by a spring which winds and thereafter runs down, before supplying the tennis ball to a user, for user's posture practice.

2. Discussion of Related Art

A conventional automatic tennis practice mechanism is employed to shoot at a high speed a tennis ball to a user, using the force caused by the air which is compressed and thereafter discharged, before struck by the user. This mechanism is adequate for an expert at playing tennis to improve his ability. But it is not proper for children or beginners to learn to posture at an early stage, and there is a problem that other people should directly throw tennis balls to the user.

In addition, the automatic tennis practice mechanism which is about 80~90 kilograms in weight, and fairly large-sized, has the problems that it is not convenient for the user to move it to another place, it is hard to purchase it for home use due to its high price, we should quit practicing playing tennis when the electric power of a charging battery is discharged, and the use of electricity of 110V and 220V causes a loss of power.

SUMMARY OF THE INVENTION

Accordingly, the present invention is directed to an automatic tennis ball supply device that substantially obviates one or more of the problems due to limitations and disadvantages of the related art.

An object of the present invention is to provide an automatic tennis ball supply device, which picks up a plurality of tennis balls in a container one by one, by means of the power generated by a spring which winds and thereafter runs down, before supplying the tennis ball to a user, for user's posture practice.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is disclosed an automatic tennis ball supply device, including: a case for protecting internal components; a container for holding a plurality of tennis balls in it; a spring which is a thin, long and rolled up steel band, for transmitting the power via its elasticity; a spring housing for preventing the spring from separating to outside by the elasticity; a spring housing fixing unit which is placed at one side of the lower portion of the case, for fixing the spring housing; a bolt connected to the respective upper portions of right and left sides of the case, for fixing part "a" which is the last part of the steel band of the spring; a plurality of nuts serving to join the bolt and the case together; a first shaft which is connected to the respective middle portions of right and left sides of the case, to be joined to part "b" which is the first part of the steel band of the spring; a handle at the right of the first shaft, for turning it to the right in order to wind the spring; a first gear which is mounted at the first shaft, and rotates in the same direction as the first shaft when the first shaft rotates; a second gear which is located between the spring housing and the first gear, and rotates to the left when the wound spring runs down, the second gear having a central aperture into which the first shaft is fitted; a latch at the left of the second gear, for disengaging the first and second gears from each other lest the second gear should rotate reversely when the spring is wound by the handle, and for engaging the first and second gears with each other so that the second gear may rotate to the left when the wound spring runs down; a third gear which rotates to the right, engaging with the second gear when the second gear rotates to the left; a second shaft which is connected to the respective middle portions of right and left sides of the case, mounted at a central aperture of the third gear, and rotates in the same direction as the rotating third gear; a rotative speed control unit which is located at one side of the right side of the case, to be joined to the right end of the second shaft, for controlling a rotative speed of the second shaft; a ball pick up unit which is placed at one side of the left side of the case, to be joined to the left end of the second shaft, and rotates in the same direction as the rotating second shaft in order to pick up and convey one of the plural tennis balls in the container; a ball guide unit which is positioned at one side of the left side of the case, for guiding the tennis ball which is picked up through the ball pick up unit, to outside; and legs for supporting the case.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 1:
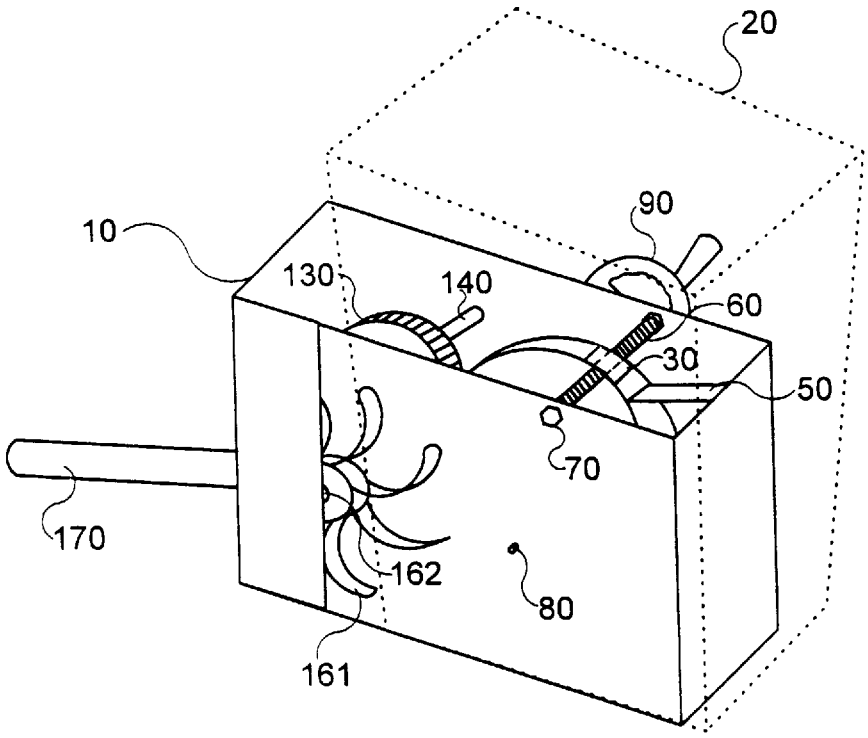
FIG. 1 is a perspective view showing a structure of an automatic tennis ball supply device according to a preferred embodiment of the present invention.
Figure 2:
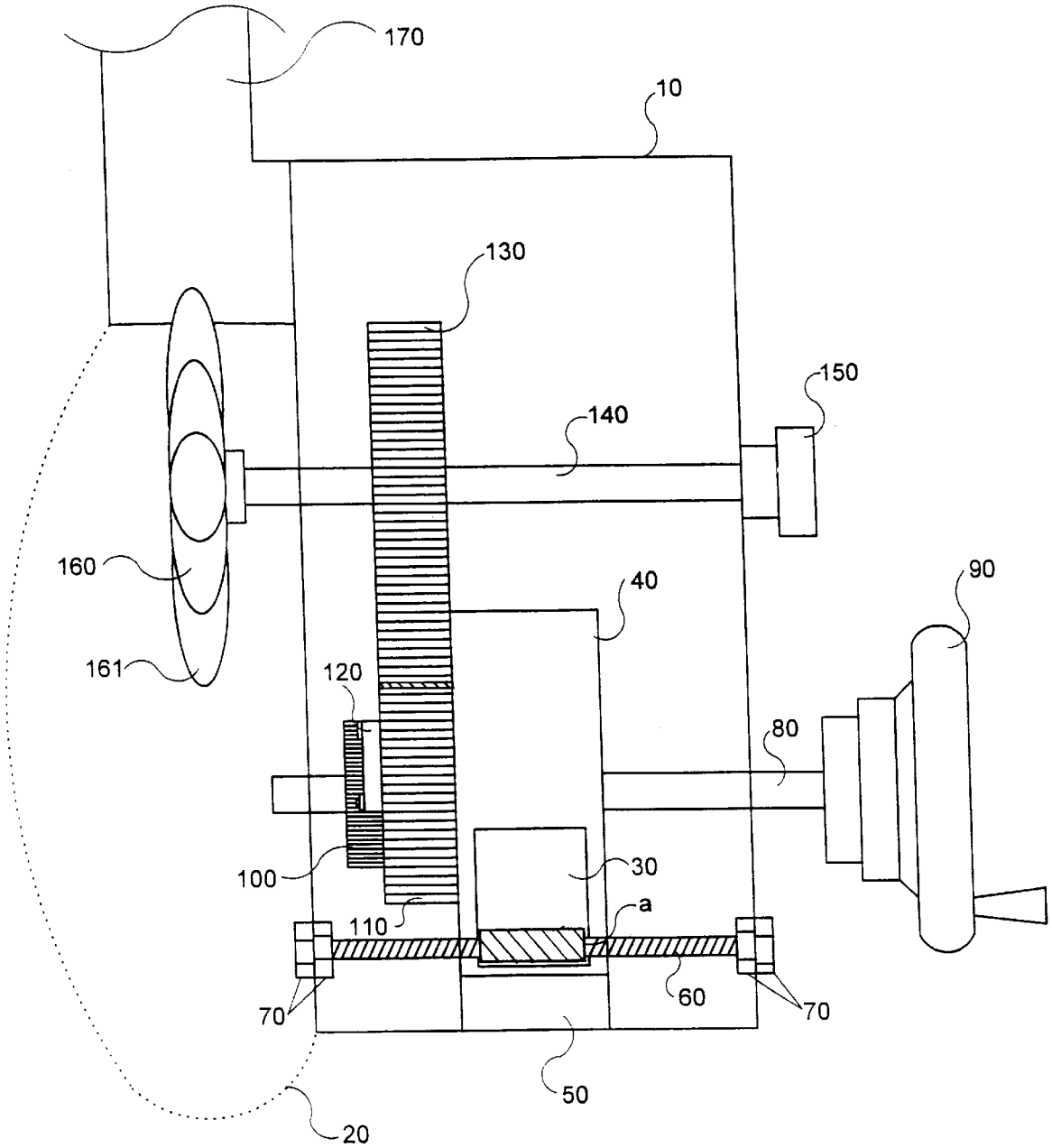
FIG. 2 is a plan view which depicts the structure of the automatic tennis ball supply device according to FIG. 1.
Figure 3:
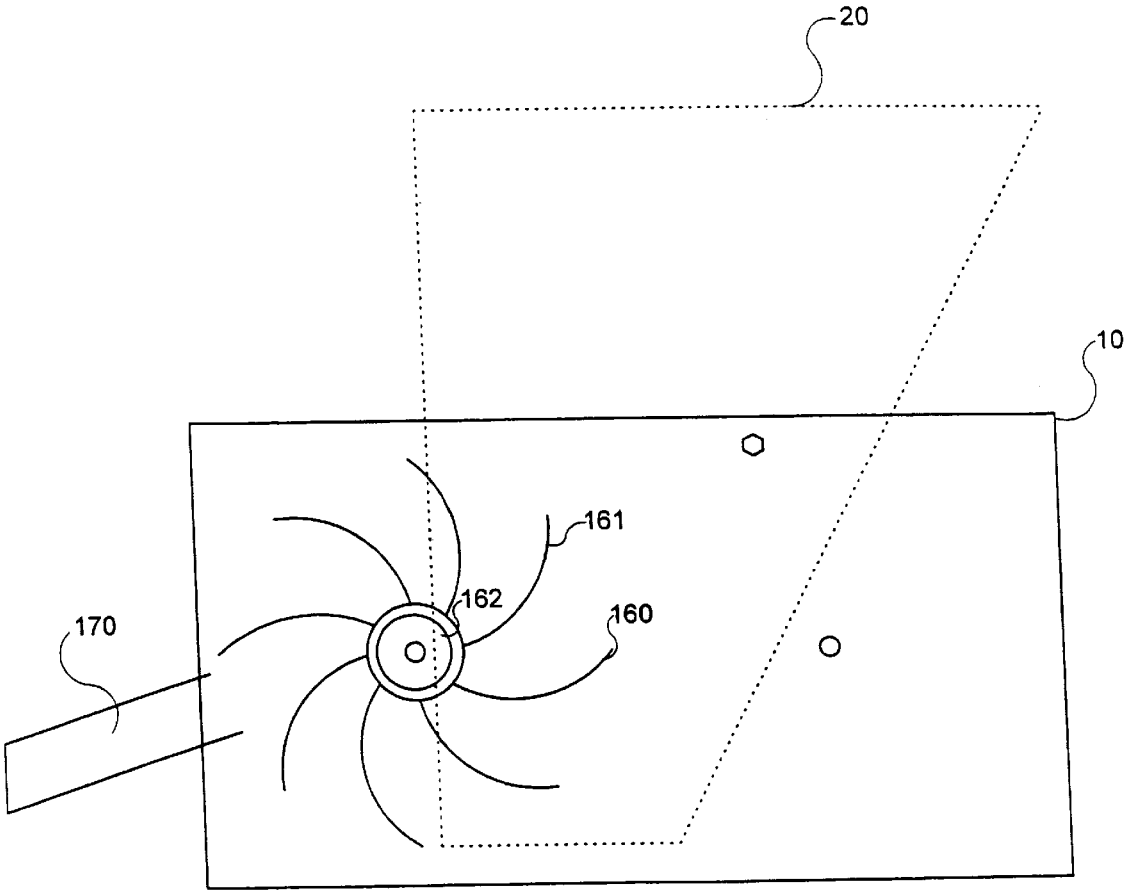
FIG. 3 is a left side view which shows the structure of the automatic tennis ball supply device according to FIG. 1.
Figure 4:
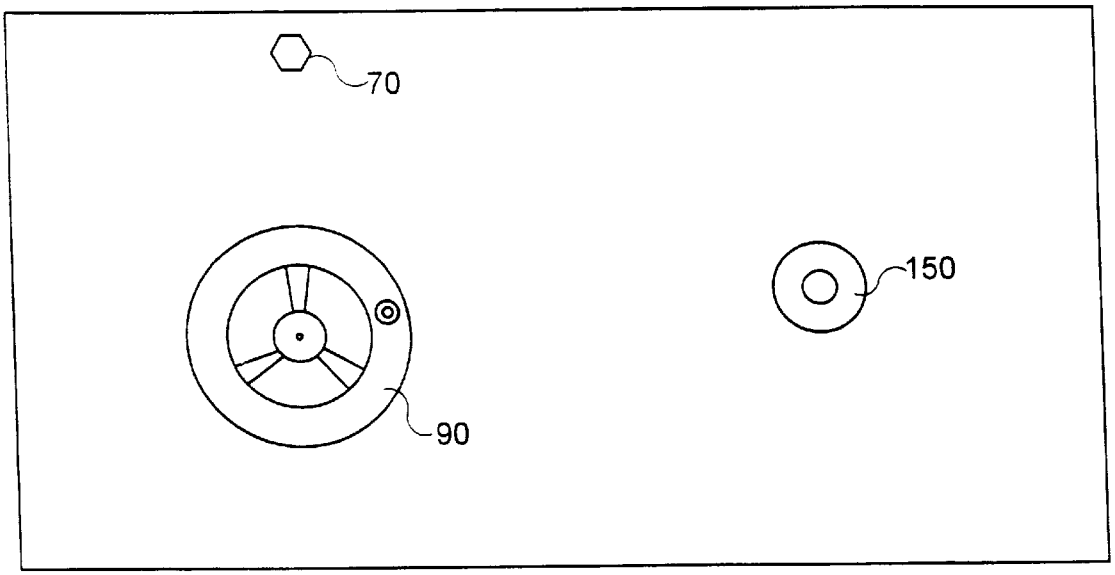
FIG. 4 is a right side view illustrating the structure of the automatic tennis ball supply device according to FIG. 1.
Figure 5:
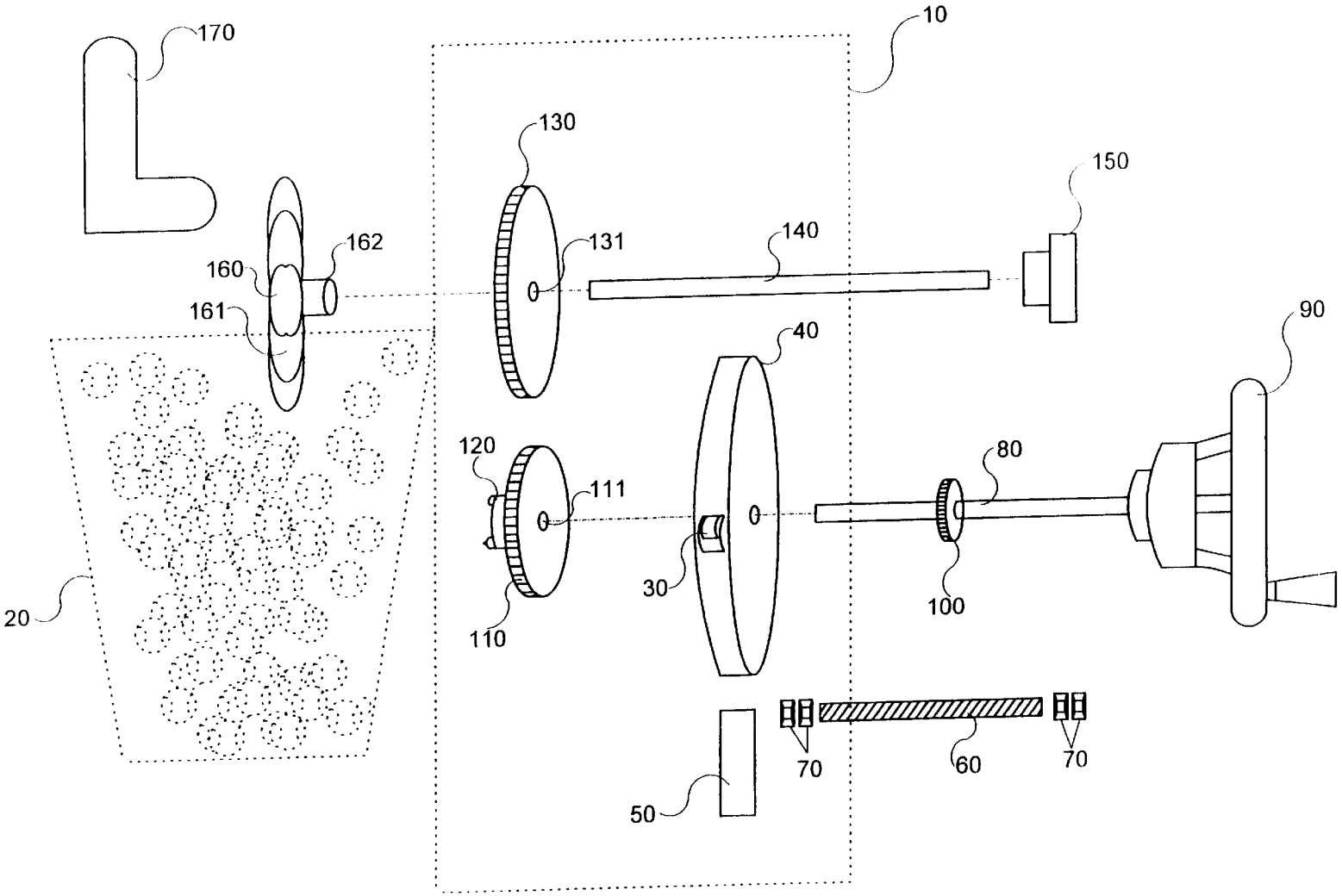
FIG. 5 is an exploded view of the automatic tennis ball supply device according to FIG. 1.

As illustrated in FIG. 1, a case 10 serves to protect internal component parts, namely a spring 30, a spring housing 40, a spring housing fixing unit 50, a first shaft 80, a first gear 100, a second gear 110, a latch 120, a third gear 130, and a second shaft 140 in it.

A container 20 can hold about 130~200 tennis balls, and a spring 30 is a thin, long and rolled up steel band, for transmitting the power to the first shaft 80 via its elasticity. The spring housing 40 prevents the spring 30 from separating to outside by the elasticity, and the spring housing fixing unit 50 is placed at one side of the lower portion of the case 10, for fixing the spring housing 40 at the case 10, to thereby fix the spring 30.

A bolt 60 is connected to the respective upper portions of right and left sides of the case 10, for fixing part "a" which is the last part of the steel band of the spring 30, and a plurality of nuts 70 join the bolt 60 and the case 10 together. And the first shaft 80 is connected to the respective middle portions of right and left sides of the case 10, to be joined to part "b" which is the first part of the steel band of the spring 30.

A handle 90 lies at the right of the first shaft 80, for turning it to the right in order to wind the spring 30. The first gear 100 is mounted at the first shaft 80, rotating in the same direction as the first shaft 80 when the first shaft 80 rotates. The second gear 110 with a first central aperture 111 into which the first shaft is fitted, is located between the spring housing 40 and the first gear 100, and rotates to the left when the wound spring 30 runs down.

The latch 120 is at the left of the second gear 110, for disengaging the first and second gears 100 and 110 from each other for fear that the second gear 110 should rotate reversely when the spring 30 is wound by the handle 90, and for engaging the first and second gears 100 and 110 with each other in order that the second gear 110 may rotate to the left when the wound spring 30 runs down. The third gear 130 rotates to the right, engaging with the second gear 110 when the second gear 110 rotates to the left.

The second shaft 140 is connected to the respective middle portions of right and left sides of the case 10, mounted at a second central aperture 131 of the third gear 130, and rotates in the same direction as the rotating third gear 130. A rotative speed control unit 150 is located at one side of the right side of the case 10, to be joined to the right end of the second shaft 140, for controlling a rotative speed of the second shaft 140.

A ball pick up unit 160 includes: a plurality of conveyance members 161 which are placed at one side of the left side of the case 10, to pick up one of the plural tennis balls in the container 20, before conveying it to a ball guide unit 170; and a joining unit 162 which is joined to the left end of the second shaft 140, for maintaining the plural conveyance members 161, at specified intervals, and rotates in such a way that the conveyance members 161 rotate in the same direction as the rotating second shaft 140.

The ball guide unit 170 is positioned at one side of the left side of the case 10, for guiding the tennis ball which is picked up through the ball pick up unit 160, to outside, and legs 180 which are separable from the case 10, serve to support the case 10.

The following description relates to the operation of the automatic tennis ball supply device as constructed above, referring to the appended drawings.

The case 10 is employed to protect the spring 30, the spring housing 40, the spring housing fixing unit 50, the first shaft 80, the first gear 100, the second gear 110, the latch 120, the third gear 130, and the second shaft 140, which are mounted in it. Approximately 130~200 tennis balls are held in the container 20.

When a user turns the handle 90 to the right with the purpose of practicing tennis posing, the first shaft 80 rotates to the right, being connected to the respective middle portions of right and left sides of the case 10, and joined to part "b" which is the first part of the steel band of the spring 30.

Here, the spring 30 which is a thin, long and rolled up steel band, is mounted within the spring housing 40. The first shaft 80 rotates to the right such that spring 30 is rolled up with the part "b" as its starting point, and the part "a" of the spring 30 is fixed by the bolt 60.

The bolt 60 is joined to the respective upper portions of right and left sides of the case 10 via the plurality of nuts 70.

The first gear 100 is mounted at the first shaft 80, rotating in the same direction as the first shaft 80 when the first shaft 80 rotates. The second gear 110 with a first central aperture 111 into which the first shaft is fitted, is located between the spring housing 40 and the first gear 100, and rotates to the left when the spring 30 is wound and then runs down.

However, the latch 120 at the left of the second gear 110, serves to disengage the first and second gears 100 and 110 to make them not engaged with each other even if the first gear 100 rotates by means of the first shaft 80 rotating to the right. Accordingly, the second gear 110 does not rotate, and only the spring 30 is wound.

The spring housing 40 is fixed at one side of the lower portion of the case 10, by means of the the spring housing fixing unit 50.

The spring 30 is entirely wound up, and then runs down by its elasticity, generating the power. And the first shaft 80 rotates to the left via the power generated by the spring 30, causing the first gear 100 mounted thereat to also rotate to the left.

Here, the latch 120 engages the first and second gears 100 and 110 with each other, in order that the second gear 110 may rotate to the left when the first gear 100 rotates to the left by the spring 30 which is wound and then runs down. Therefore, the third gear 130 which engages with the second gear 110, gets to rotate to the right, when the second gear 110 rotates to the left.

The second shaft 140 is connected to the respective middle portions of right and left sides of the case 10, mounted at the second central aperture 131 of the third gear 130, and rotates in the same direction, i.e., to the right, as the rotating third gear 130.

The rotative speed control unit 150 which is located at one side of the right side of the case 10, and joined to the right end of the second shaft 140, serves the functions for locking the second shaft 140 not to rotate, and controlling a rotative speed of the second shaft 140 by stages.

For example, the second shaft 140 rotates most slowly at a first stage, it rotates at a middle speed at a second stage, and it rotates most rapidly at a third stage.

If the rotative speed of the second shaft 140 is selected to be the speed equivalent to the third stage, by the rotative speed control unit 150, the second shaft rotates at a speed equivalent to the third stage, and the joining unit 162 which is joined to the left end of the second shaft 140, rotates in the same direction, i.e., to the right, as the rotating second shaft 140.

In addition, as the joining unit 162 rotates to the right, the conveyance members 161 which are, at regular intervals, placed at the joining unit 162, pick up one of the plural tennis balls in the container 20, before conveying it to the ball guide unit 170.

The ball guide unit 170 positioned at one side of the left side of the case 10, guides the tennis ball which is conveyed by the conveyance members 161 of the ball pick up unit 160, to the user.

Figure 6:
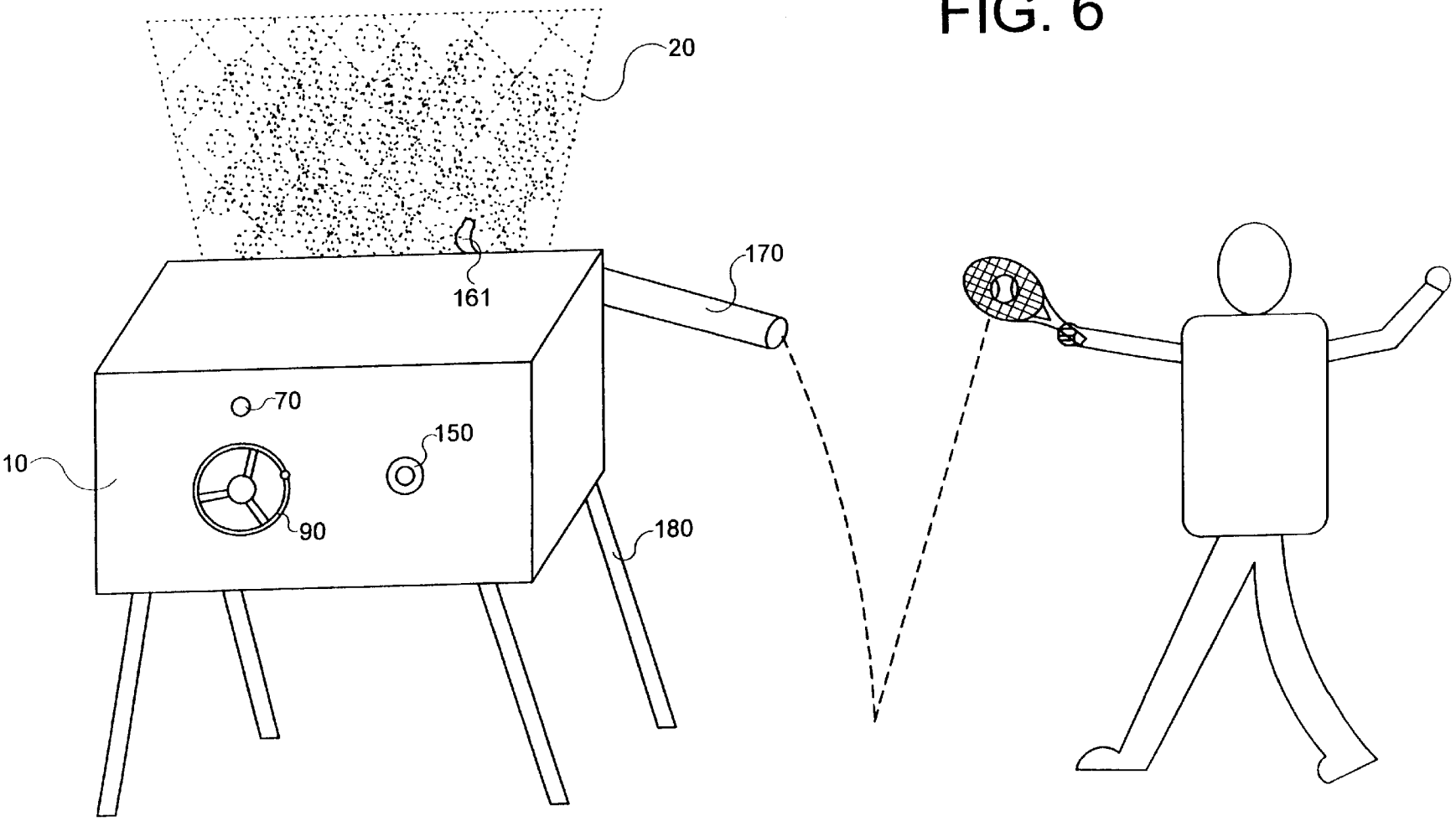
FIG. 6 depicts that a user practices playing tennis by the use of the automatic tennis ball supply device according to FIG. 1.
Figure 7:
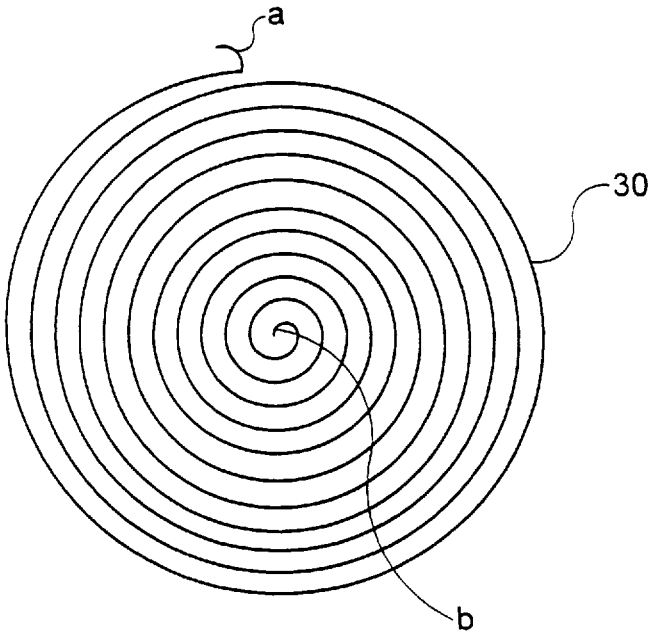
FIG. 7 shows a spring of the automatic tennis ball supply device according to FIG. 1.

As depicted in FIG. 6, therefore, the user strikes, with a tennis racket, the tennis ball which drops from the ball guide unit 170 and bounces back from the ground, in order to practice the tennis posture.

The legs 180 which are separable from the case 10, serve to support the case 10. The height of the legs can be adjusted in accordance with the users' stature.

In case the user selects the function for locking use of the rotative speed control unit 150, to stop practicing the tennis posture, the second shaft 140 stops rotating, discontinuing the operation of the ball pick up unit 160, so that the tennis balls are not discharged to outside.

After the user completely winds the spring 30 up, in order to practice playing tennis, he can use about 130~200 tennis balls while the spring 30 runs down entirely.

The present invention is made out of plastic, aluminum, and tungsten materials, and thus its weight is light, thereby decreasing the production cost.

As described above, the automatic tennis ball supply device of the present invention, is given the power generated by the spring which is wound and then runs down, and thus picks up the plural tennis balls in the container one by one, before supplying the ball to the user, for user's tennis posture practice. Therefore, it is convenient to automatically supply the balls, instead of other people's throwing the balls to the user directly. And it is also useful to the expert, children and beginners to practice the tennis posture since the balls are, at a low speed, dropped just in front of them.

Additionally, the automatic tennis ball supply device according to the present invention weighs light, due to its materials of plastic, aluminum, and tungsten, so that it is convenient for the user to move it to another place. The present invention which is inexpensive by the use of the natural principle of the spring, enables the user to purchase it for home use. The power is transmitted to the present invention via the elasticity of the spring, not using a charging battery in such a way that the maintenance expenses resulting from a loss of power can be removed. Furthermore, it can be solved to quit practicing playing tennis when the electric power of a charging battery is discharged, and a loss of power is not caused because electricity is not used in this automatic tennis ball supply device.

It will be apparent to those skilled in the art that various modifications and variations can be made in the automatic tennis ball supply device of the present invention without departing from the spirit or scope of the invention. Thus, it is intended that the present invention cover the modifications and variations of this invention provided they come within the scope of the appended claims and their equivalents.

What is claimed is:

1. An automatic tennis ball supply device, comprising:

a case for protecting internal components;

a container for holding a plurality of tennis balls in it;

a spring which is a thin, long and rolled up steel band, for transmitting the power via its elasticity;

a spring housing for preventing the spring from separating to outside by the elasticity;

a spring housing fixing unit which is placed at one side of the lower portion of the case, for fixing the spring housing;

a bolt connected to the respective upper portions of right and left sides of the case, for fixing part "a" which is the last part of the steel band of the spring;

a plurality of nuts serving to join the bolt and the case together;

a first shaft which is connected to the respective middle portions of right and left sides of the case, to be joined to part "b" which is the first part of the steel band of the spring;

a handle at the right of the first shaft, for turning it to the right in order to wind the spring;

a first gear which is mounted at the first shaft, and rotates in the same direction as the first shaft when the first shaft rotates;

a second gear which is located between the spring housing and the first gear, and rotates to the left when the wound spring runs down, the second gear having a central aperture into which the first shaft is fitted;

a latch at the left of the second gear, for disengaging the first and second gears from each other lest the second gear should rotate reversely when the spring is wound by the handle, and for engaging the first and second gears with each other so that the second gear may rotate to the left when the wound spring runs down;

a third gear which rotates to the right, engaging with the second gear when the second gear rotates to the left;

a second shaft which is connected to the respective middle portions of right and left sides of the case, mounted at a central aperture of the third gear, and rotates in the same direction as the rotating third gear;

a rotative speed control unit which is located at one side of the right side of the case, to be joined to the right end of the second shaft, for controlling a rotative speed of the second shaft;

a ball pick up unit which is placed at one side of the left side of the case, to be joined to the left end of the second shaft, and rotates in the same direction as the rotating second shaft in order to pick up and convey one of the plural tennis balls in the container;

a ball guide unit which is positioned at one side of the left side of the case, for guiding the tennis ball which is picked up through the ball pick up unit, to outside; and legs for supporting the case.

2. The device as set forth in claim 1, wherein the ball pick up unit includes: a plurality of conveyance members for picking up the plural tennis balls, before conveying them; and a joining unit which is joined to the left end of the second shaft, for maintaining the plural conveyance members, at specified intervals, and rotates in such a way that the conveyance members rotate in the same direction as the rotating second shaft.

3. The device as set forth in claim 1, wherein the legs can be folded to be easily moved, and the height of the legs can be adjusted in accordance with users' stature.

* * * * *